US008662102B2

(12) United States Patent
Shaffer et al.

(10) Patent No.: US 8,662,102 B2
(45) Date of Patent: Mar. 4, 2014

(54) APPARATUS FOR REDUCING KNOB WOBBLE

(75) Inventors: Timothy Scott Shaffer, LaGrange, KY (US); Howard Richard Bowles, Louisville, KY (US); Jorge Hinojosa, Queretaro (MX)

(73) Assignee: General Electric Company, Schenectady, NY (US)

( * ) Notice: Subject to any disclaimer, the term of this patent is extended or adjusted under 35 U.S.C. 154(b) by 1014 days.

(21) Appl. No.: 12/425,469

(22) Filed: Apr. 17, 2009

(65) Prior Publication Data

US 2010/0264344 A1 Oct. 21, 2010

(51) Int. Cl.
*F16L 3/00* (2006.01)

(52) U.S. Cl.
USPC ..... 137/343; 126/52; 74/553

(58) Field of Classification Search
USPC ..... 251/291, 292, 214; 16/422; 126/1 R–276; 137/360, 343; 384/210
See application file for complete search history.

(56) References Cited

U.S. PATENT DOCUMENTS

| | | | | | |
|---|---|---|---|---|---|
| 2,005,792 | A * | 6/1935 | Leins | 126/39 R |
| 2,849,891 | A * | 9/1958 | Mills | 126/42 |
| 2,879,027 | A * | 3/1959 | Mueller | 251/292 |
| 3,687,509 | A * | 8/1972 | Schweizer | 384/210 |
| 3,764,103 | A * | 10/1973 | Oliverio | 251/292 |
| 3,937,207 | A * | 2/1976 | Kendall | 126/39 B |
| 3,998,478 | A * | 12/1976 | Zopfi | 277/607 |
| 4,150,847 | A * | 4/1979 | De Cenzo | 285/93 |
| 4,157,786 | A * | 6/1979 | Bergquist | 236/15 A |
| 4,384,737 | A * | 5/1983 | Reusser | 285/334 |
| 4,417,483 | A | 11/1983 | Howie, Jr. | |
| 4,495,547 | A | 1/1985 | Stoverock | |
| 4,920,823 | A | 5/1990 | Mohr et al. | |
| 5,328,211 | A * | 7/1994 | Lewis et al. | 285/23 |
| 5,613,275 | A | 3/1997 | Kolberg et al. | |
| 5,931,150 | A * | 8/1999 | Bowen et al. | 126/42 |
| 6,520,481 | B2 * | 2/2003 | Harneit | 251/207 |
| 7,171,728 | B2 | 2/2007 | Chirumbolo | |
| 7,651,330 | B2 * | 1/2010 | Albizuri | 126/39 R |
| 8,066,575 | B2 * | 11/2011 | Kobayashi | 464/145 |
| 2008/0202496 | A1 * | 8/2008 | Albizuri | 126/39 R |

FOREIGN PATENT DOCUMENTS

WO WO 2007074630 A1 * 7/2007

* cited by examiner

*Primary Examiner* — Eric Keasel
(74) *Attorney, Agent, or Firm* — Global Patent Operation; Douglas D. Zhang

(57) ABSTRACT

A gas appliance including a frame and a control knob assembly connected to the frame, the control knob assembly including a gas valve with a valve stem, a control knob attached to the valve stem, and a valve restraint. The valve restraint is substantially fixed relative to the frame and longitudinally disposed substantially between the gas valve and control knob, and is configured to limit lateral movement of the valve stem.

16 Claims, 18 Drawing Sheets

APPARATUS FOR REDUCING KNOB WOBBLE

BACKGROUND OF THE INVENTION

The exemplary embodiments of the present invention generally relate to knobs. More particularly, the exemplary embodiments relate to reducing knob wobble when the knob is operated.

Generally, mechanical valves are used to control the flow of gas in, for example, a gas operated appliance such as a cooktop. Stems coming out of the valves are rotated to control the onset of flow as well as the flow rate. Generally, while the valve body is hidden from view, the stem will extend through openings in a surface of the appliance so that a control knob can be affixed to the stem. The length of the stem and the construction of the valve often lead to an undesirable level of lateral wobble or play in the control knob.

Gas appliance control knobs are generally loose feeling when compared to for example, electrical appliance or electronic control knobs. The looseness of the gas appliance control knobs may be due to the nature of the gas valve and stem assembly and to the fairly large distances between the consumer interface point on the control knob and the valve body. For example, the stem extending from a gas valve may generally have anywhere from 0.5 to 2.0 degrees of angular play (See FIGS. 1A and 1B). In some applications the distance between the control knob and the valve body can be over 2 inches. This combination of stem length and angular play can lead to lateral movement of the control knob of about three tenths of an inch during operation of the control knob. As a comparison, control knobs for other appliances such as radios and receivers have a play of about two to three hundredths of an inch.

BRIEF DESCRIPTION OF THE INVENTION

As described herein, the exemplary embodiments overcome one or more of the above or other disadvantages known in the art.

One aspect of the exemplary embodiments relates to a gas appliance. The gas appliance includes a frame and a control knob assembly connected to the frame, the control knob assembly including a gas valve with a valve stem, a valve restraint and a control knob. The valve restraint is substantially fixed relative to the frame and longitudinally disposed substantially between the gas valve and control knob, and is configured to limit lateral movement of the valve stem.

Another aspect of the exemplary embodiments relates to a control knob assembly for a gas cooking appliance, the gas cooking appliance having a control panel with at least one wall. The control knob assembly including a gas valve including a valve stem having a longitudinal axis, the gas valve being disposed on a first side of the wall, a control knob non-rotatably connected to the valve stem, the control knob being disposed at least partly on a second side of the wall and a bushing disposed along the longitudinal axis and between the gas valve and control knob, the bushing being configured to limit lateral movement of the valve stem and control knob.

Still another aspect of the exemplary embodiments relates to a gas cooking appliance. The gas cooking appliance includes a control panel having at least one wall, and a control knob assembly mounted directly to the at least one wall, the control knob assembly including a gas valve with a valve stem, a bushing and a control knob, the valve stem and control knob being connected to each other for simultaneous rotation about a longitudinal axis, the bushing being configured to interface with one or more of the valve stem and control knob for limiting lateral movement of the valve stem and control knob.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1B:
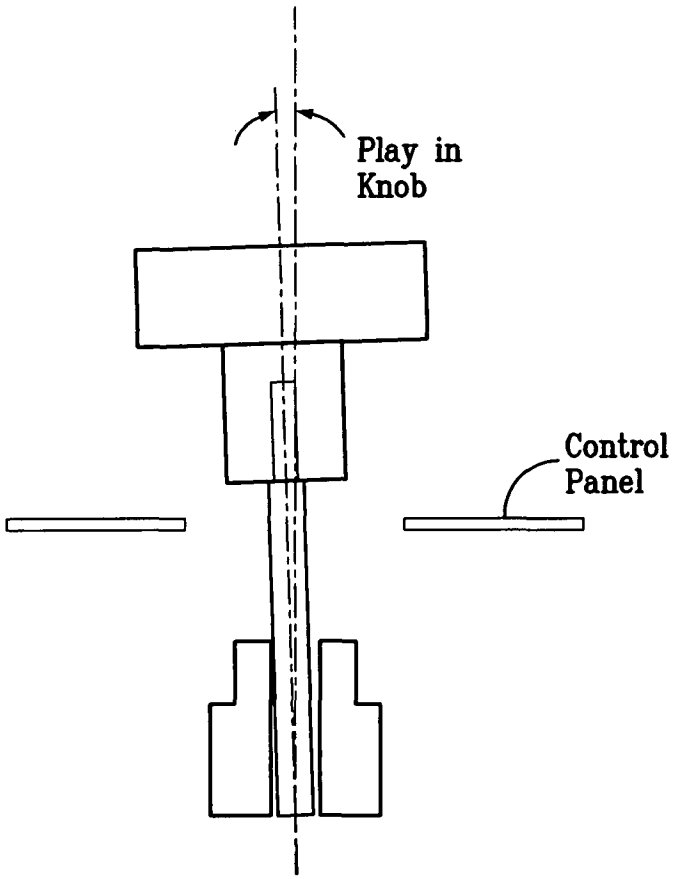
Prior Art FIG. 1B
FIGS. 1A and 1B illustrate play in a knob of a conventional device.
Figure 1A:
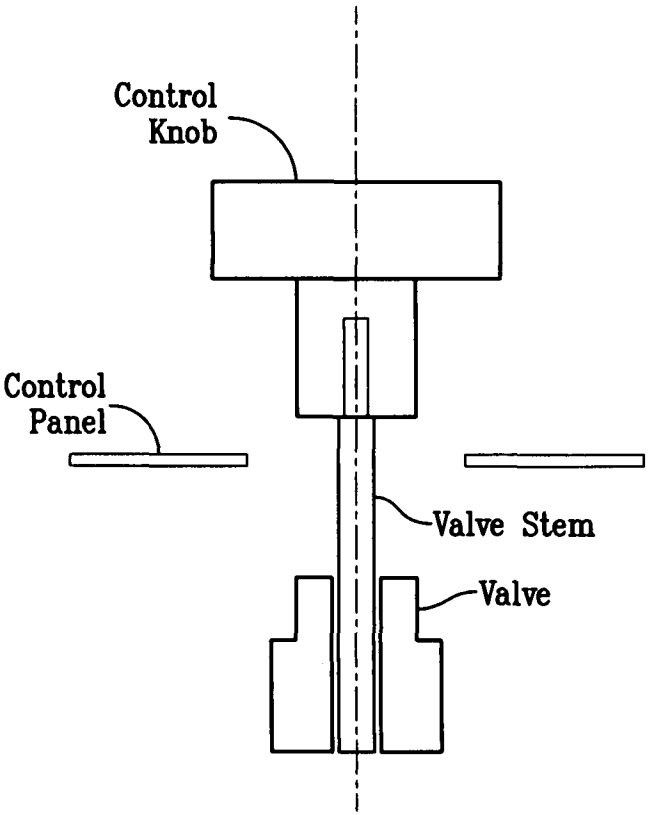
Prior Art FIG. 1A
Figure 2B:
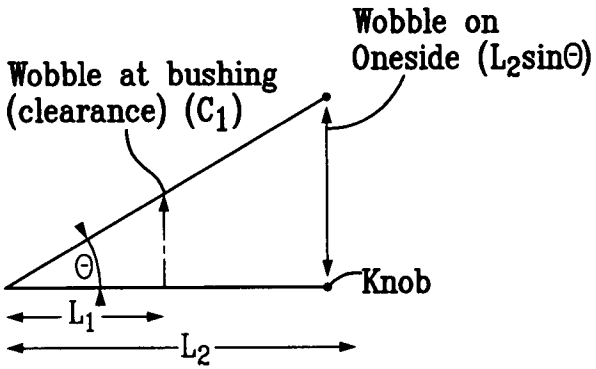
FIG. 2 illustrates a reduction of play in a control knob assembly in accordance with an exemplary embodiment.
Figure 2A:
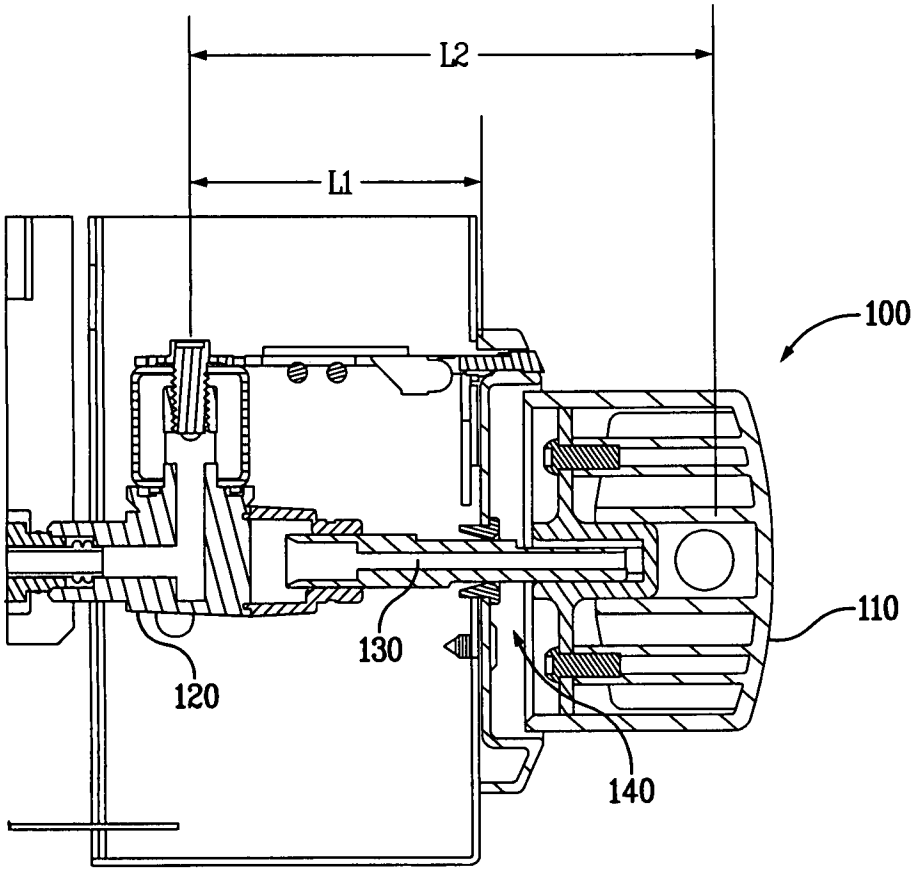
Figure 4:
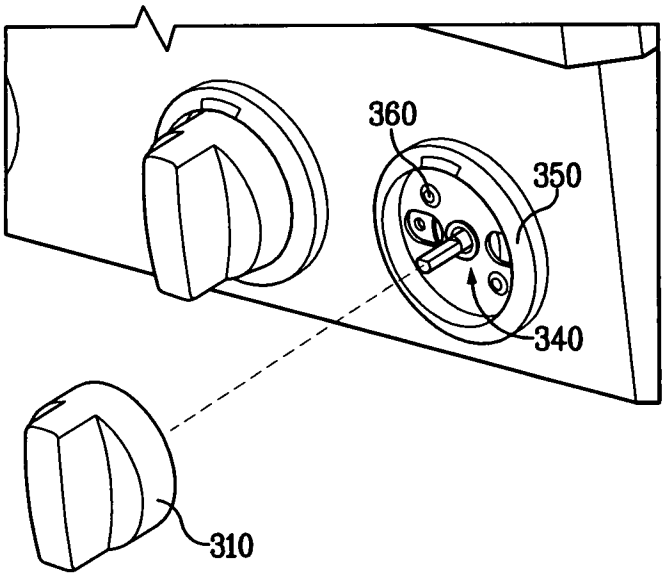
FIGS. 3 and 4 are exploded perspective views of a portion of a control knob assembly in accordance with an exemplary embodiment.
Figure 3:
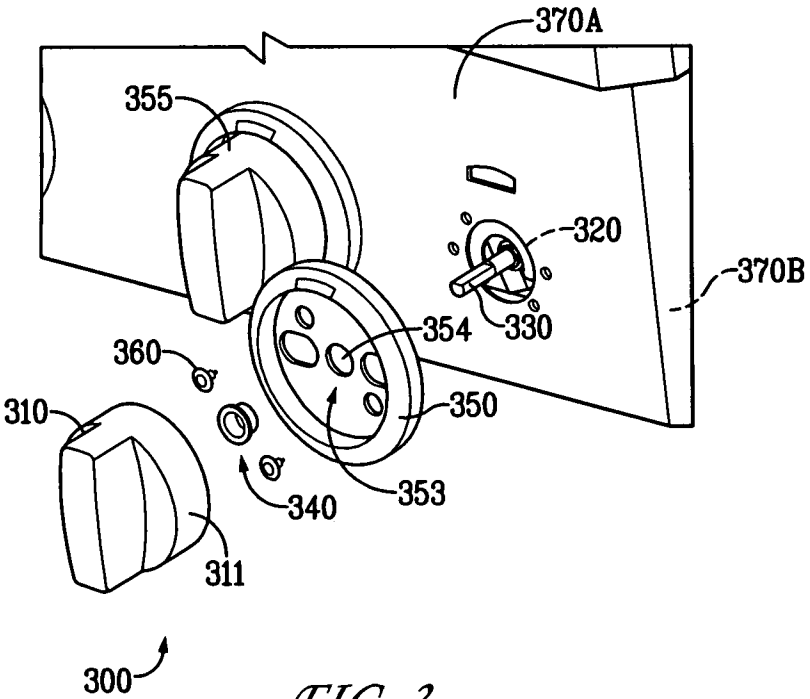

FIG. 2 illustrates a control knob assembly in accordance with an exemplary embodiment. As can be seen in FIG. 2 the control knob assembly includes a gas valve 120, a valve stem 130, a stem restraint 140 and a control knob 110. The control knob 110 is mounted to the valve stem 130 in any suitable manner to allow for the opening, closing and adjustment of the valve 120. The stem restraint 140, as will be described herein limits the wobble or play in the control knob 110 during operation of the control knob 110. It is noted that the term wobble as used herein is defined as radial or lateral movement of the control knob caused by a force that is applied substantially perpendicular or at an angle to a longitudinal axis of the valve stem.

In accordance with the exemplary embodiments and for exemplary purposes only, the clearance between the valve restraint 140 and the valve stem 130 on one side C1 may be about 0.005 inches. The distance L1 between the valve 120 and the valve restraint 140 may be about 1.921 inches. For exemplary purposes only, the maximum valve angle is θ (e.g. the angular deviation of the valve stem from a nominal or centered position) where sin θ=(C1/L1) so that θ is about 0.002618 radians. The distance L2 between the valve and the operating point of the control knob 100 (e.g. the point at which a user grasps for rotating the control knob) may be, for example, about 3.26 inches. The wobble on one side of the control knob 110 may be calculated as L2*sin θ where, in this example, the wobble on one side of the control knob 110 at the knob operating point is about 0.008534 inches. The total wobble of the control knob 110 (e.g. the bilateral deviation of the control knob on either side of the nominal or centered position) at the knob operating point is, for example, about 0.01707 inches. As such, the valve restraint 140 of the exemplary embodiments provides a reduction of control knob wobble over conventional control knob assemblies for gas appliances. The valve restraint 140 may have any suitable configuration such as for example, collars, bushings or other suitable guide ways. It is noted that the above example of wobble reduction is exemplary in nature and that the exemplary embodiments described herein may be employed to limit knob wobble in any suitable manner and for any suitable distances between the control knob operating point and gas valve.

Referring now to FIGS. 3-11B, a control knob assembly 300 in accordance with the exemplary embodiments will be described. In this example, the control knob assembly 300 includes, gas valve 320, valve stem 330, bezel 350, valve restraint such as bushing 340 and control knob 310. As can be seen in FIGS. 10A and 10B the gas valve 320 may be mounted to a gas manifold 365 in any suitable manner. The gas manifold 365 may include mounting brackets 366B for securing the gas manifold 365 and gas valve 320 assembly to a wall of a control panel 370 of an appliance, such as for example a gas cooktop. The wall of the control panel 370 may have a first and second sides such that the gas valve is located on a first side of the wall 370B and the control knob is located at least partly on a second side of the wall 370A. The mounting brackets 366B may be secured directly to the control panel in any suitable manner such as with, for example, suitable fasteners 361 (FIG. 11A). It is noted that while the gas manifold 365 is shown as having additional mounting brackets 366A, the mounting brackets 366A are not used such that variations in mounting the gas valves 320 are minimized. As can be seen in FIG. 10B a suitable space 367 exists between the mounting brackets 366A and a frame 367 of the appliance and/or control panel 370. In alternate embodiments the mounting brackets 366A may rest on or be affixed to the frame 367 in any suitable manner. The valve stem 330 may be coupled to the gas valve 320 for allowing operation of the gas valve 320. The valve stem may have a bushing contact surface 321 configured to interact with the bushing as described below.

Figure 6:
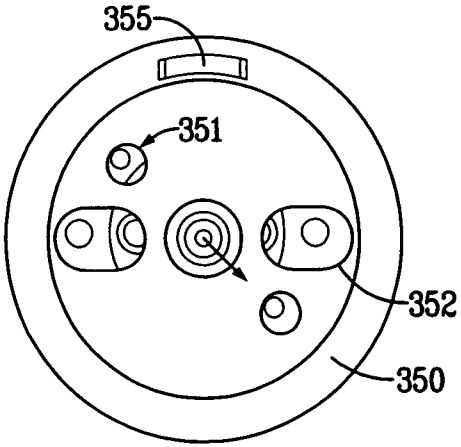
FIGS. 5, 6, 7A and 7B are schematic illustrations of portions of the control knob assembly of FIGS. 3 and 4.
Figure 7B:
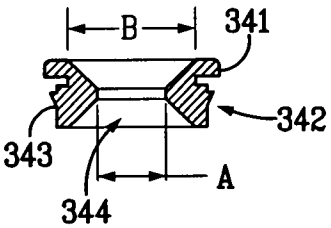
Figure 5:
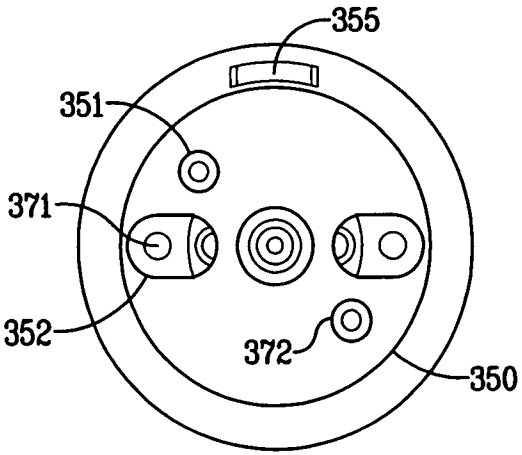
Figure 7A:
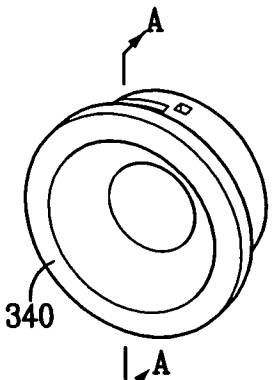
Figure 11B:
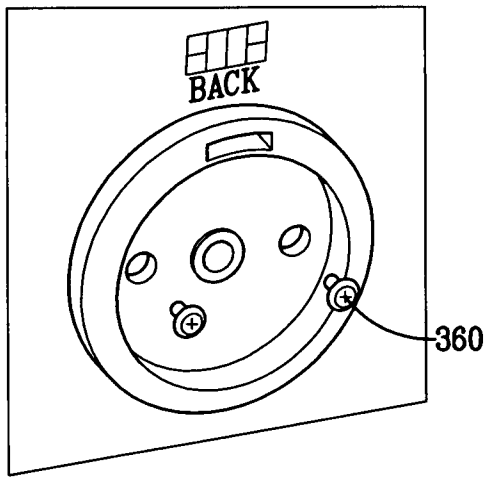
FIGS. 11A and 11B are schematic illustrations exemplary bezels of the control knob assembly of FIGS. 3 and 4.
Figure 11A:
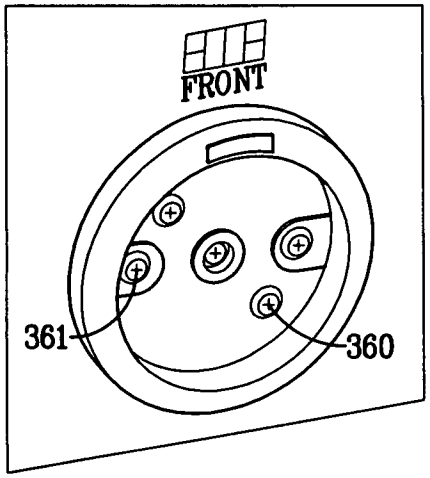
Figure 12:
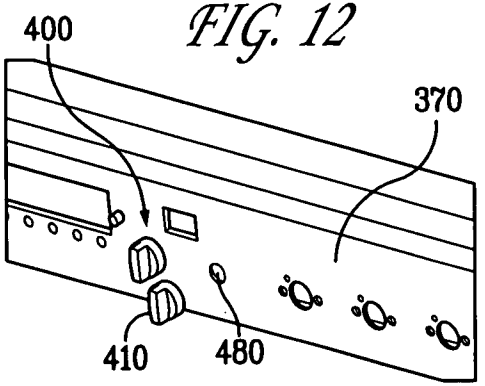
FIG. 12 is a schematic illustration of a control knob assembly and a partial exploded illustration of a control knob assembly in accordance with an exemplary embodiment.
Figure 13:
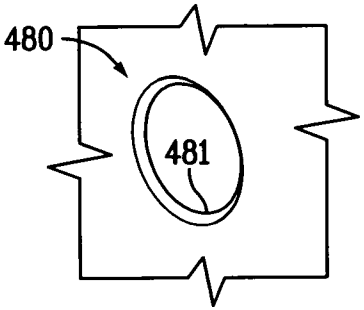
FIGS. 13 and 14 are schematic illustration of portions of the control knob assembly of FIG. 12.
Figure 14:
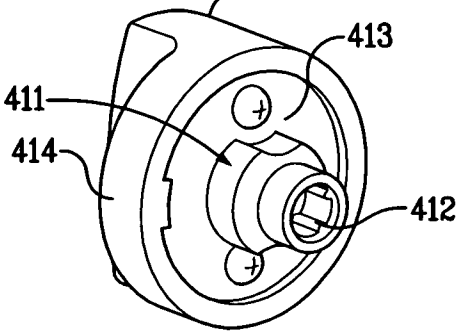
Figure 15:
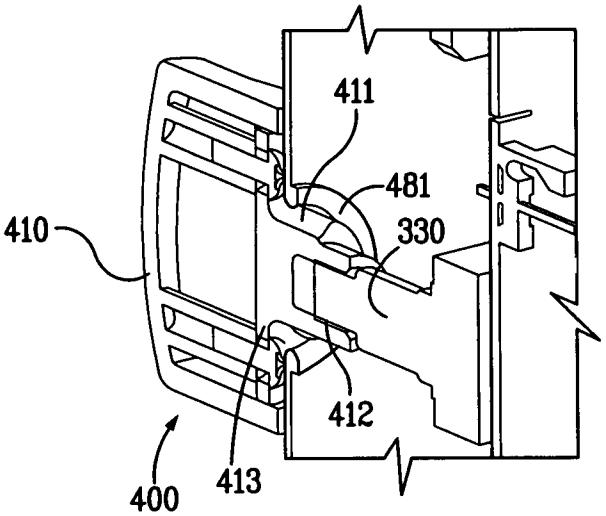
FIGS. 15 and 16 are respectively perspective and partial perspective cross-sectional illustrations of the control knob assembly of FIG. 12.
Figure 16:
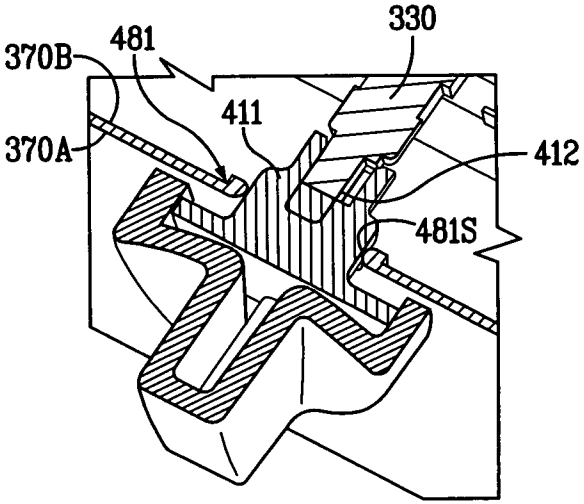
Figure 18:
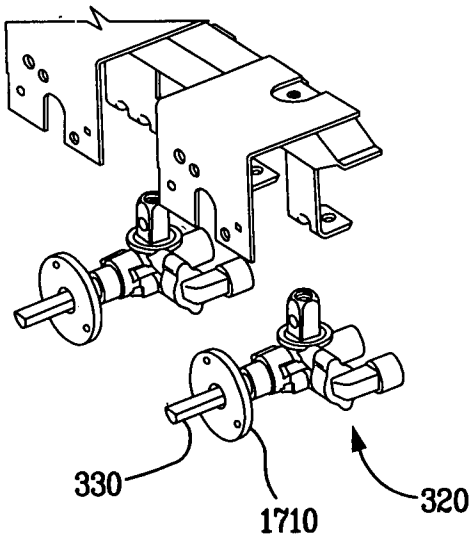
FIGS. 17 and 18 are schematic exploded illustrations of a portion of control knob assembly in accordance with an exemplary embodiment.
Figure 17:
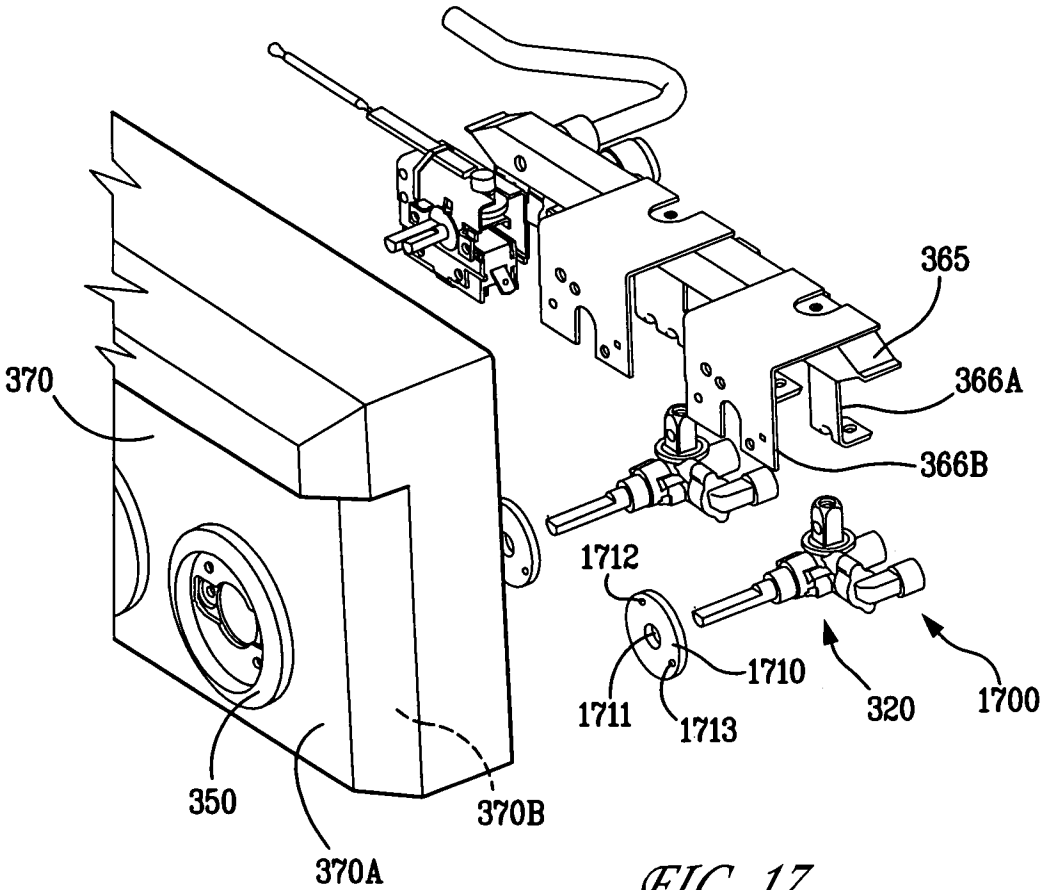
Figure 20:
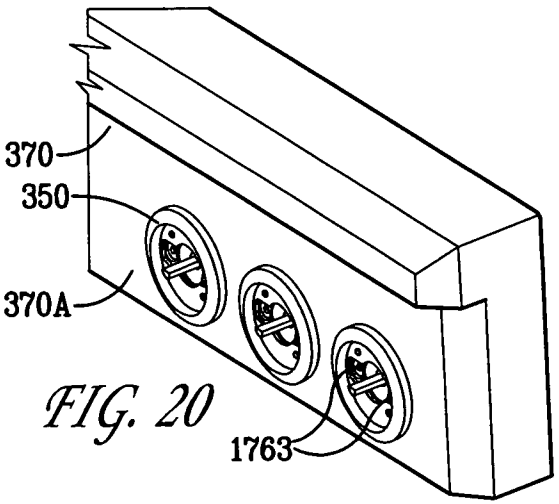
FIGS. 19-22 are schematic illustrations of portions of the control knob assembly of FIGS. 17 and 18.
Figure 22:
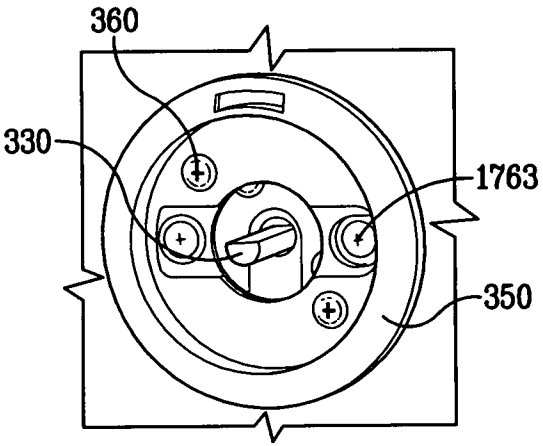
Figure 19:
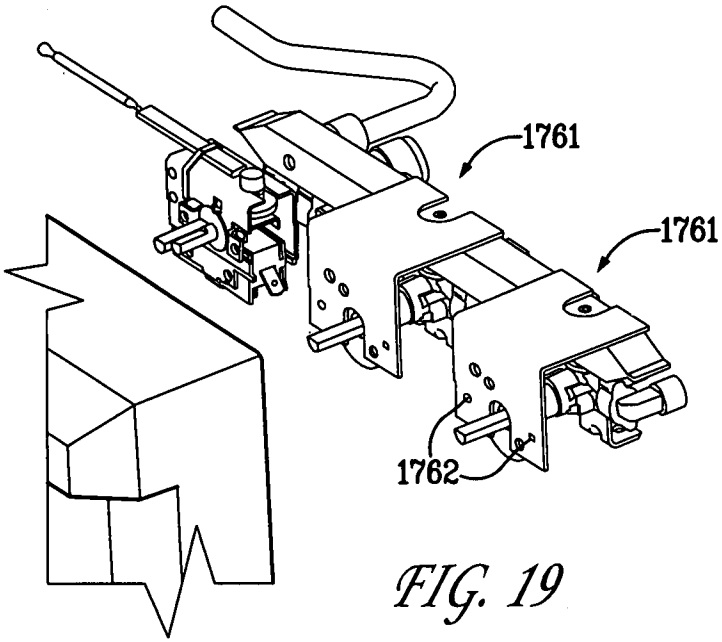

The bezel 350 may be constructed of any suitable material or combination of materials (e.g. metal, plastic, etc.) and have any suitable shape and or configuration for interfacing with the control panel 370 and/or the control knob 310. In this example, the bezel 350 includes a recessed area 353 into which the control knob 310 is partly inserted. The bezel 350 also includes an aperture 354 through which the valve stem 330 passes. The bezel 350 may be placed on the a surface of the control panel 370 on the second size of the wall 370A by passing the bezel 350 over the valve stem 330 so that the valve stem protrudes through aperture 354. The bezel 350 may include one or more mounting holes 351 and clearance holes 352. The mounting holes 351 and/or clearance holes 352 may be suitably sized to allow for misalignment between the gas valve/valve stem and the bezel 350. For example, the mounting holes 351 and/or clearance holes 352 may allow for movement of the bezel 350 relative to fastener holes 371, 372 in the control panel 370 as shown in FIGS. 5 and 6. Any suitable fastener 360 (e.g. screws, clips, etc.) may be inserted through the mounting holes 351 for securing the bezel 350 to the control panel 370. The clearance holes 352 may provide adequate clearance for the fasteners 361 that secure the mounting brackets 366B to the control panel 370 (see FIG. 11A). In alternate embodiments the bezel 350 may be secured to the control panel 370 in any suitable manner such as with, for example, chemical fasteners. In other exemplary embodiments the bezel 350 and the mounting brackets 366B may be secured to the control panel 370 by a common set of fasteners 360 as shown in FIG. 11B. A slot 355 with, for example, a lens cap may be provided in the bezel 350 to permit light to pass from a light source within the control panel 370 through the slot 355. The light may be configured to illuminate a setting indicator 311 on the control knob 310. In one example, the slot 355, bezel 350 and or light source may include any suitable light guide for transferring the light through the bezel without hindering operation of the control knob assembly 300.

The aperture 354 of the bezel 350 may also be configured to accept bushing 340. The bushing 340 may be constructed of any suitable material and have any suitable configuration for reducing the wobble of the control knob assembly 300 as describe herein. In one example, the bushing may be constructed of a self lubricating material. For exemplary purposes only, the bushing 340 includes a flange 341 for resting on a surface of the recessed area 353 of the bezel 350, an outside diameter configured to interact with the aperture 354 and an aperture 344 through which the valve stem 330 passes. In this exemplary embodiment the outside diameter 343 of the bushing 340 includes a fastening device 342 such as, for example, a snap that cooperates with the flange 341 for securing the bushing 340 within the aperture 354. In alternate embodiments the bushing may be held within the bezel 350 in any suitable manner. The aperture 344 of the bushing 340 may be configured to minimize surface contact with the valve stem 330. For example, the aperture 344 may be tapered from a first diameter B at the ends of the bushing 340 to a second diameter A at a point between the ends of the bushing. Here the second diameter A is smaller than the first diameter B and is disposed substantially equidistant from the ends of the bushing 340. In alternate embodiments the aperture 344 may have any suitable configuration for minimizing surface contact with the valve stem 330. It is noted that the smallest diameter of the aperture 344 of the bushing 340 may be sized such that the valve stem 330 slips through the bushing 340 and is restrained from large lateral movements by a contact surface of the diameter A while allowing unrestrained axial travel and rotation of the valve stem 330 and or knob 310. It is noted that the bushing 340 may be inserted into the aperture 354 before or after the bezel 350 is placed against the surface of the second side of the wall 370A of the control panel 370.

Figure 9:
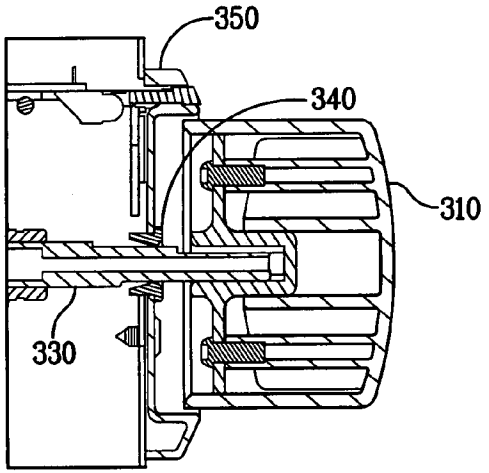
FIG. 9 is a partial sectional view of a portion of the control knob assembly of FIGS. 3 and 4.
Figure 10B:
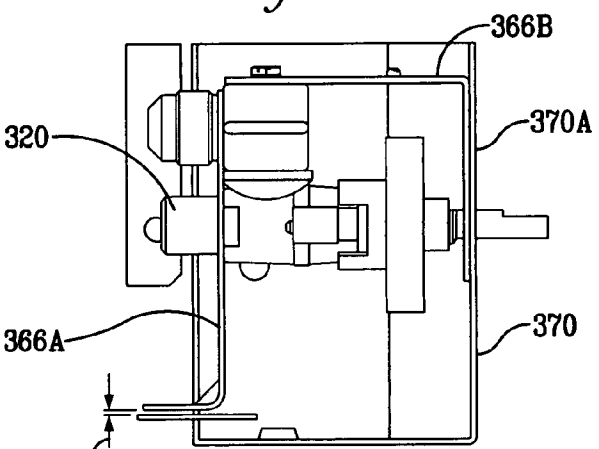
FIGS. 10A and 10B are schematic illustrations of a portion of the control knob assembly of FIGS. 3 and 4.
Figure 8:
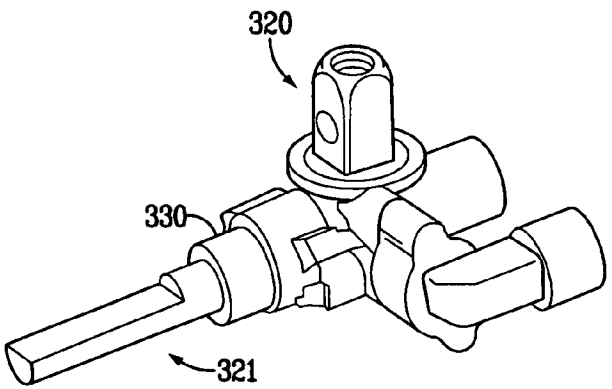
FIG. 8 is a schematic illustration of an exemplary valve and valve stem of the control knob assembly of FIGS. 3 and 4.
Figure 10A:
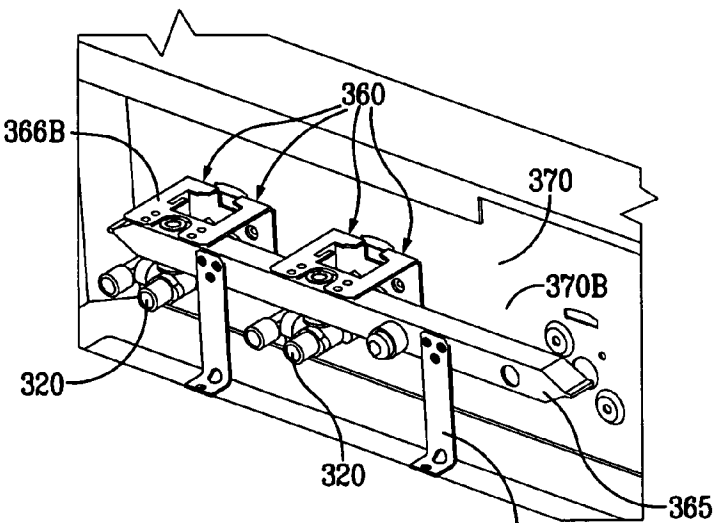

The control knob 310 may be any suitable knob having any suitable setting indicator(s) 311 disposed thereon for indicating to a user a setting of the appliance. The control knob 310 may be suitably sized to at least partly fit within the recessed area 353. The control knob 310 may also be configured to slip over and non-rotatably engage the valve stem 330 so that rotation of the control knob 310 also rotates the valve stem 330 for operating the gas valve 320. FIG. 9 illustrates an exemplary assembly of the control knob assembly 300.

Referring to FIGS. 12-16 another exemplary control knob assembly 400 will be described in accordance with an exemplary embodiment. The control knob assembly 400 may be substantially similar to control knob assembly 300 (e.g. FIG. 3) described above unless otherwise noted. In this exemplary embodiment, the control panel 370 includes an aperture 480 for receiving the valve stem 330. The edge 481 of the aperture 480 may be flared, extruded or otherwise shaped to provide a contact surface 481S for forming the valve restraint.

The control knob 410 in this example includes an interface portion 414 and a bushing portion 413. The interface portion 414 may be suitably shaped for grasping by a user and include setting indicators as described above with respect to control knob 310 (e.g. FIG. 3). The interface portion 414 may include a recess into which the bushing portion 413 is inserted and secured. It is noted that the bushing portion 413 may be non-rotatably secured to the interface portion in any suitable manner including, but not limited to, mechanical and chemical fasteners. The interface portion 414 and bushing portion 413 may also include mating grooves and/or protrusions (or other suitable features) for preventing relative rotation between the interface portion 414 and bushing portion 413. It is noted that while the interface portion 414 and bushing portion 413 are shown as individual components that are secured together, in alternate embodiments they may be of unitary or one-piece construction. The bushing portion 413 may include a bushing surface 411 and a valve stem interface portion 412. The bushing surface 411 may be configured to interface with the contact surface 481S and may be sized such that the bushing surface 411 slips through the aperture 480 and is restrained from large lateral movements while allowing unrestrained axial travel and rotation of the valve stem 330 and/or knob 410. The valve stem interface portion 412 may be configured for non-rotatably securing the control knob 410 to the valve stem 330 so that the rotation of the control knob 410 causes rotation of the valve stem 330 for operating the gas valve 320.

Referring now to FIGS. 17-22 a control knob assembly 1700 will be described in accordance with an exemplary embodiment. The control knob assembly 1700 may be substantially similar to control knob assembly 300 (e.g. FIG. 3) described above unless otherwise noted. In this exemplary embodiment the control knob assembly includes a valve restraint such as bushing 1710 for restraining the wobble of the control knob 310 in a manner substantially similar to that described above. It is noted that the shape and configuration of the bushing 1710 shown in the Figures is for exemplary purposes only and in alternate embodiments the bushing 1710 may have any suitable configuration for restraining wobble of the control knob 310. In this example, the bushing 1710 may be constructed of a self-lubricating material as described above with respect to bushing 340 (e.g. FIG. 7A). In alternate embodiments the bushing 1710 may be constructed of any suitable material. In this example the bushing 1710 includes an aperture 1711 configured to allow the valve stem 330 to pass through the bushing. The aperture 1711 may include a tapered surface such as that shown in FIG. 7B to minimize contact with the valve stem 330. In alternate embodiments the aperture may not be tapered so as to provide a larger contact surface when compared to the contact surface formed by the tapered aperture of FIG. 7B. The valve stem 330 may be inserted through the aperture 1711 so that a bushing interface surface (similar to interface surface 321 of FIG. 8) interacts with a contact surface of the aperture 1711 for restricting the wobble of the control knob 310. The bushing may also include mounting holes 1712, 1713 for securing the bushing to the bracket 366B and/or a surface of the first side of the wall 370B of the control panel 370.

Figure 21:
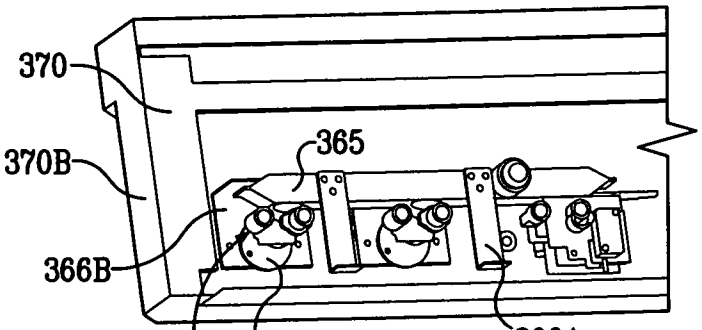

Still referring to FIGS. 17-22 the bushing 1710 may be fit over the valve stem 330. The valve 320 may be secured to the gas manifold 365 in any suitable manner. In one example, the bushing 1710 may be secured to the bracket 366B in any suitable manner, such as for example, any suitable mechanical or chemical fasteners. Here mechanical fasteners 1762 such as screws secure the bushing 1710 to the bracket. In other examples, the bracket 366B and the bushing 1710 may be secured to a surface of the control panel 370 by common fasteners such as screws 1763. For example, the screws 1763 may pass through the control panel 370 and the bushing for engaging threads within mounting holes 1712, 1713 for securing the bracket 366B (and everything mounted thereto including the gas valve 320, valve stem 330, gas manifold 365, etc.) and the bushing 1710 to the control panel 370 as shown in FIG. 21. The valve stem 330 may protrude past a surface of the second wall 370A of the control panel 370 through the bezel 350 to allow mounting of the control knob 310 to the valve stem 330. In alternate embodiments a bushing contact surface of the control knob (see e.g. FIGS. 12-16) may pass through the bezel to interface with the bushing 1710 and valve stem.

Figure 23:
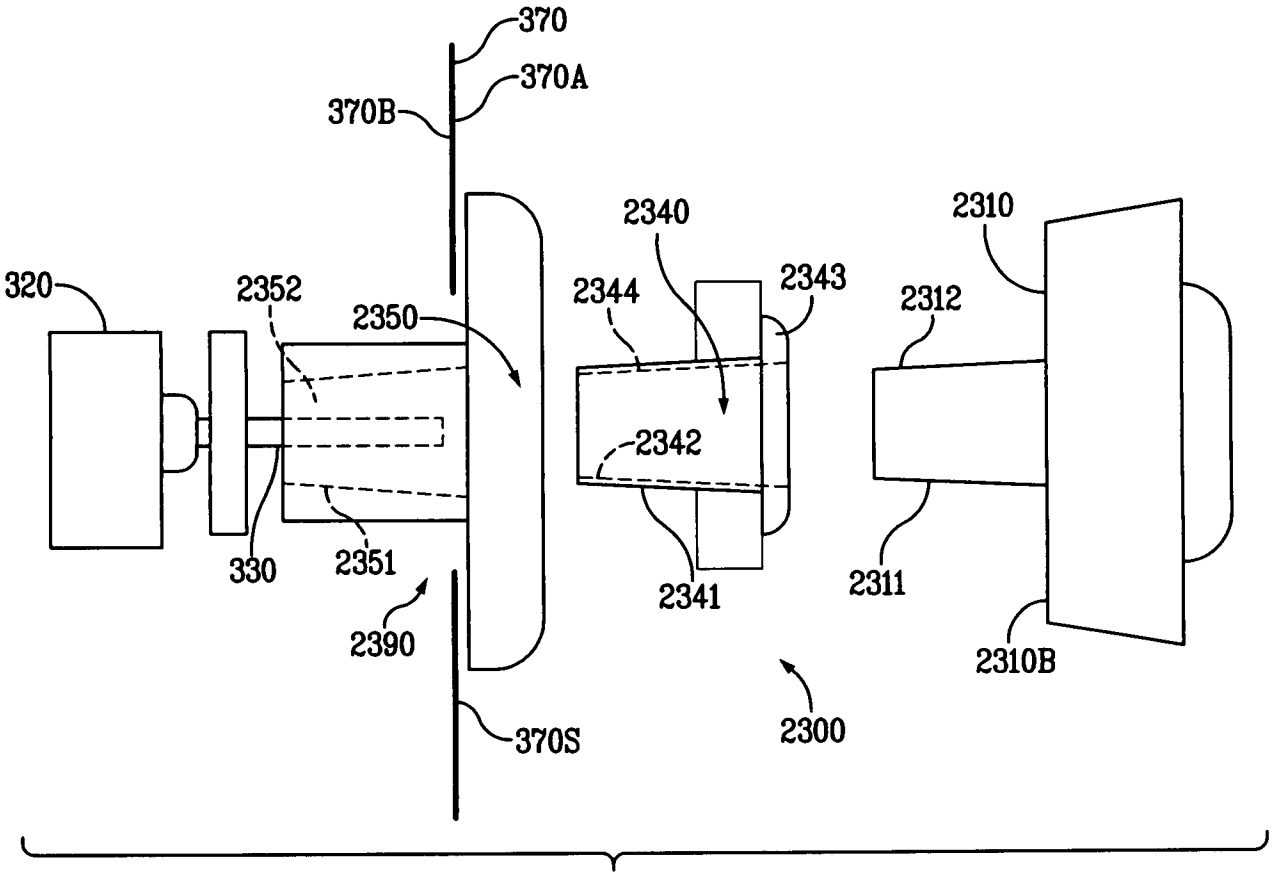
FIGS. 23 and 24 are respectively an exploded illustration and a partial exploded illustration of a control knob assembly in accordance with an exemplary embodiment.
Figure 24:
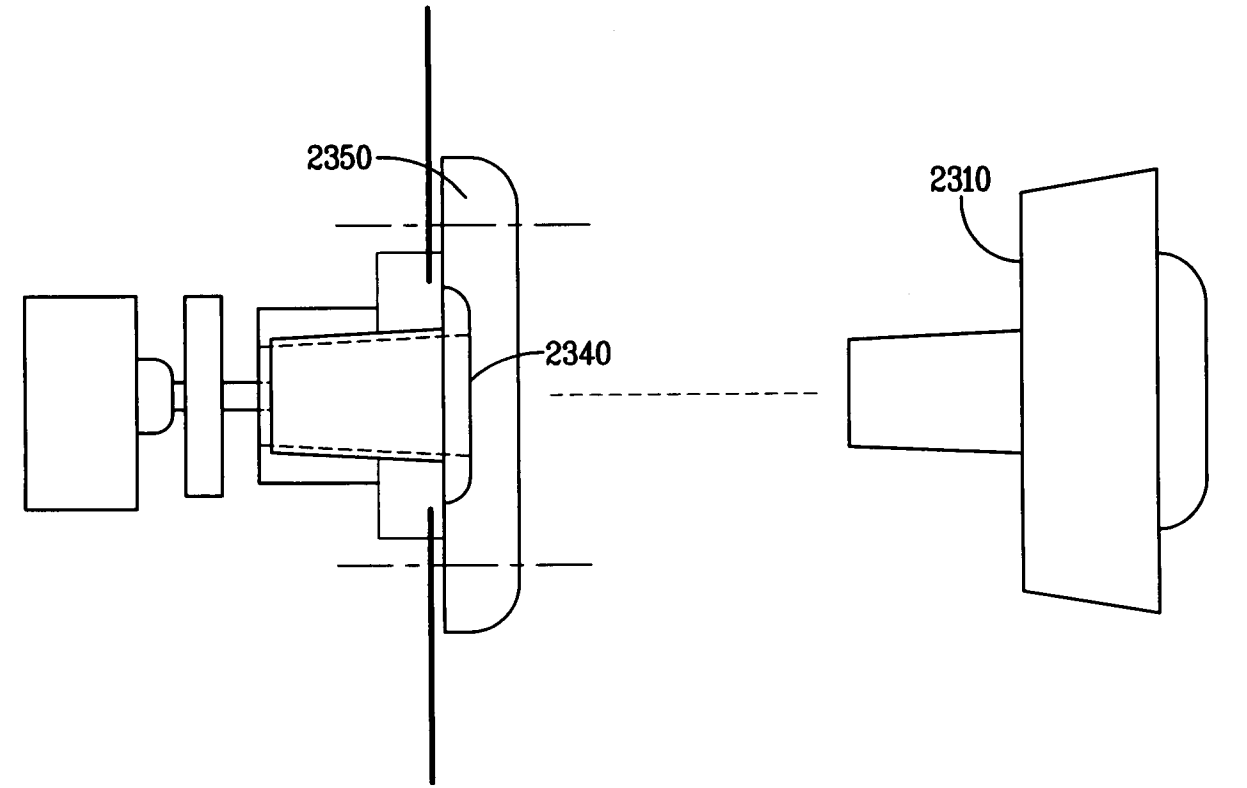
Figure 25:
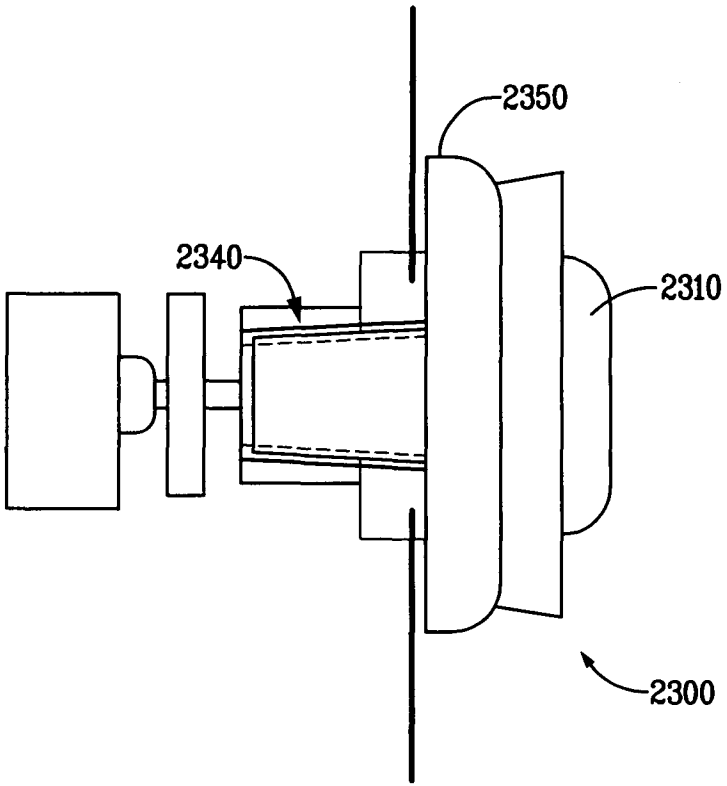
FIG. 25 is a schematic illustration of the control knob assembly of FIGS. 23 and 24.
Figure 27:
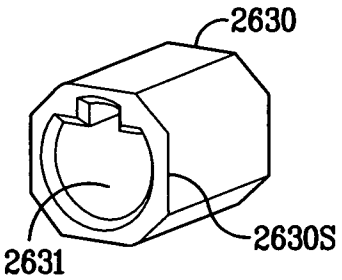
FIGS. 26-33 are schematic perspective illustrations of control knob assembly in accordance with an exemplary embodiment.
Figure 28:
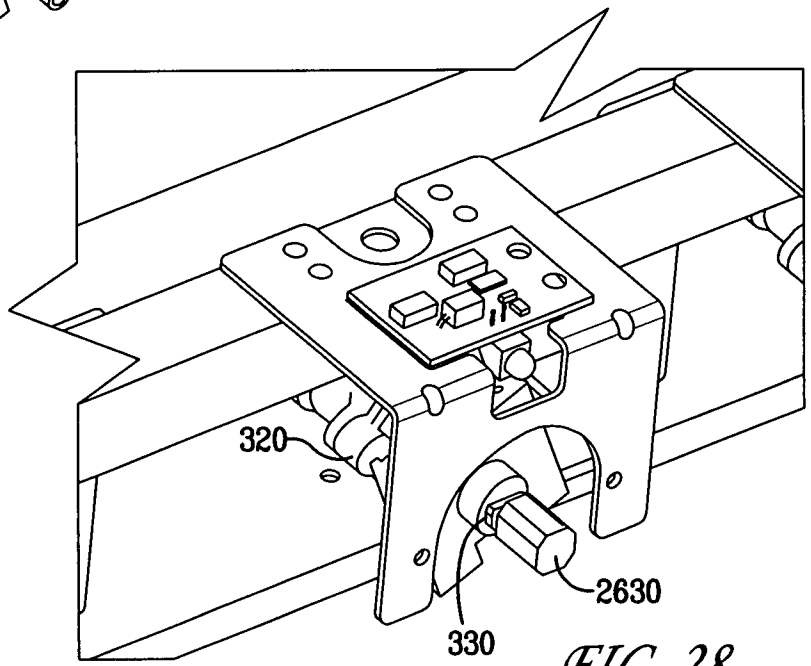
Figure 26:
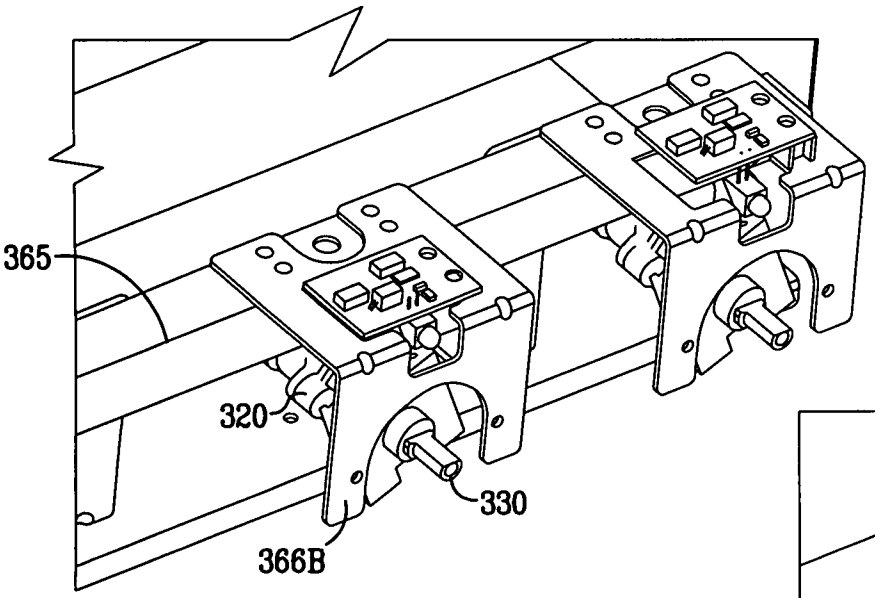
Figure 30:
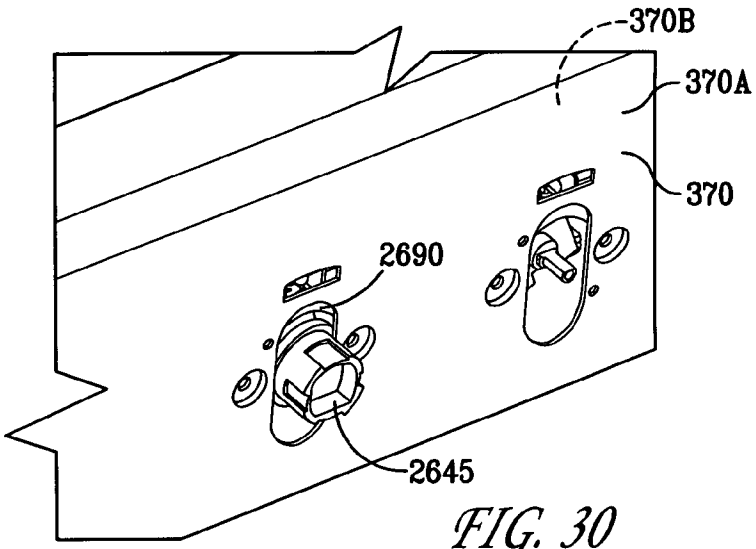
Figure 29:
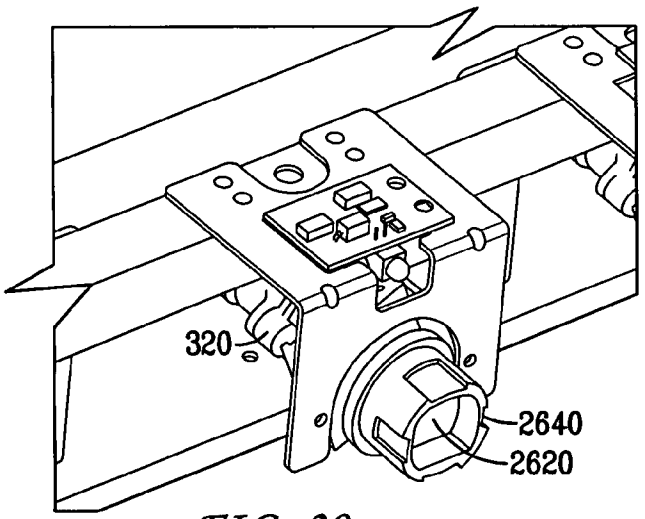
Figure 31C:
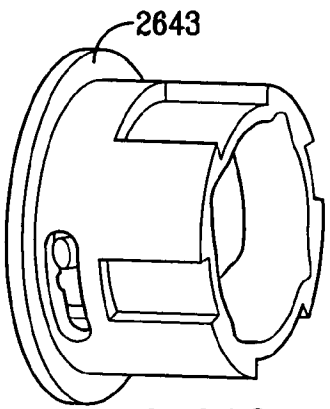
Figure 31B:
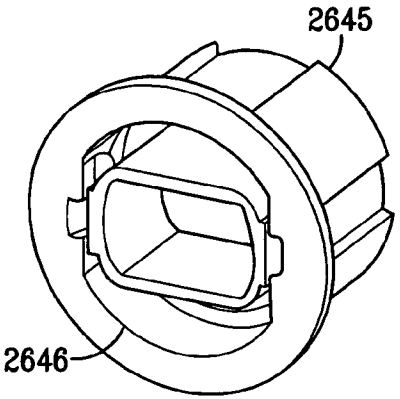
Figure 31A:
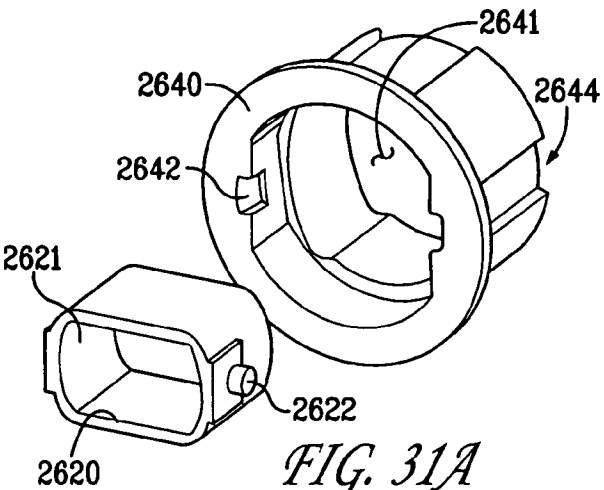
Figure 33:
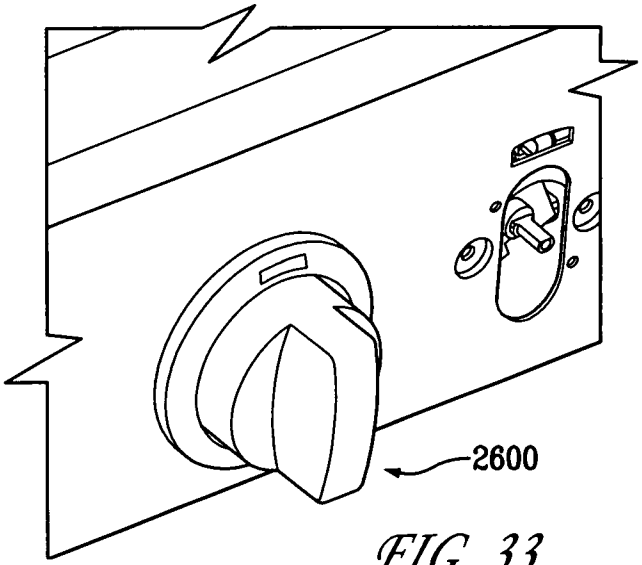
Figure 34B:
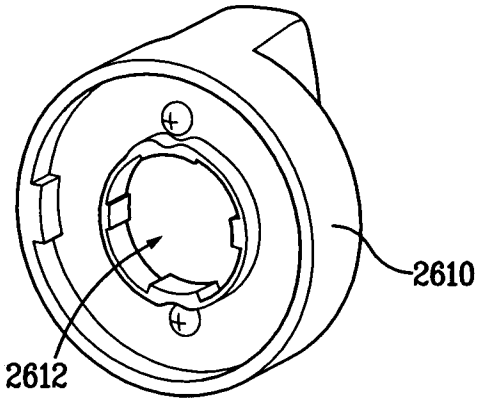
Figure 32:
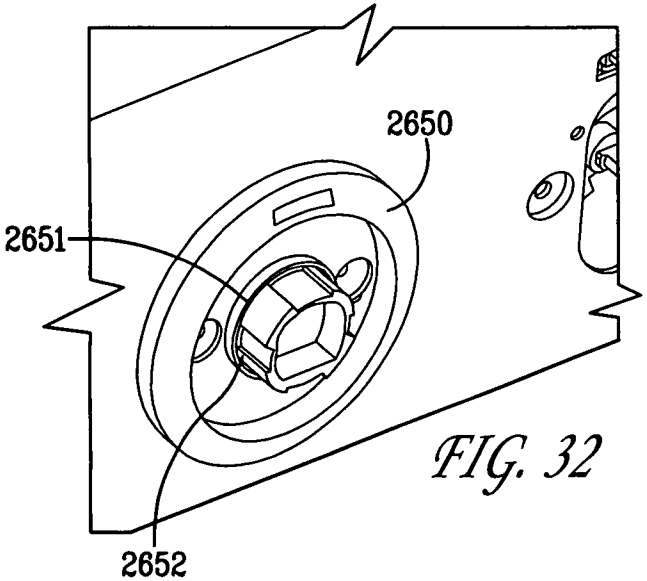
Figure 34A:
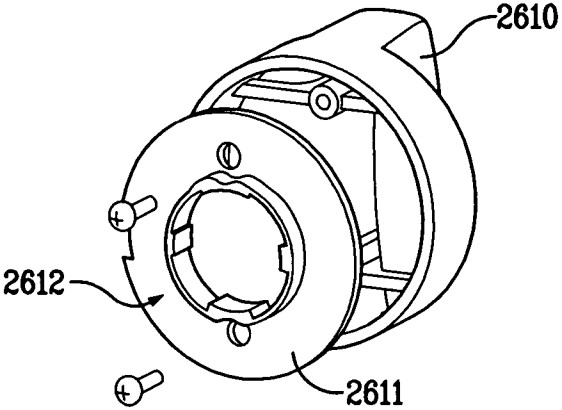

Referring to FIGS. 23-25 another exemplary control knob assembly 2300 will be described in accordance with an exemplary embodiment. In this example the control knob assembly 2300 includes a bezel 2350, a valve restraint such as bushing 2340, a control knob 2310, a gas valve 320 and a valve stem 330. The control knob assembly 2300 may be substantially similar to control knob assembly 300 (e.g. FIG. 3) described above unless otherwise noted. In this example, the gas valve 320 and valve stem 330 are secured to the control panel 370 in a manner similar to that described above. A bezel 2350 is secured to the control panel 370 in a manner similar to that described above such as with any suitable mechanical or chemical fasteners. In this example at least part of the bezel 2350 extends through aperture 2390 in control panel 370. The part of the bezel extending through aperture 2390 may include a bushing contact surface 2351. The bushing contact surface 2351 is shown as defining a tapered hole 2352 in the bezel 2350 such that the widest diameter of the tapered hole 2352 faces the control knob 2310 and the smallest diameter of the tapered hole 2352 faces the gas valve 320. In alternate embodiments the bushing contact surface 2351 may have any suitable shape and or contour.

The bushing 2340 may be any suitable bushing constructed of any suitable material, such as a self-lubricating material. The bushing 2340 is shown as having an elongated shape with a bezel contact surface 2341 and a flange 2343. The bezel contact surface 2341 may have any suitable shape and or size that may be complementary to or conforms with the bushing contact surface 2351 of the bezel 2350 which in this example, is a tapered contour. The bushing 2340 includes a knob contact surface 2343 that may have any suitable size and shape such as, for example, the tapered hole 2344 shown in FIGS. 23-25. In this example, the knob contact surface 2342 is tapered such that the widest diameter of the tapered hole 2344 faces towards the control knob 2310 and the smallest diameter of the tapered hole 2344 faces the gas valve 320. The flange 2343 of the bushing 2340 may be configured to contact a surface of the bezel 2350, such as a recessed surface in an area similar to recessed area 353. In one exemplary embodiment the flange 2343 may be configured to control how far the bushing 2340 is inserted into the tapered hole 2352.

The control knob 2310 may be substantially similar to control knob 310 (e.g. FIG. 3) described above. However in this example, the control knob 2310 includes a bushing contact surface 2311 that extends away from a base 2310B of the control knob. In this example, the bushing contact surface 2311 includes a protrusion 2312 extending from the base 2310B that has a shape complimentary to or conforming with the control knob contact surface 2342 of the bushing 2340 (or vice versa) so that the protrusion 2312 may be inserted into the bushing 2340. The protrusion 2312 may also include an aperture configured to non-rotatably engage the valve stem 330 so that rotation of the control knob 2310 operates the gas valve 320.

In this example, the control knob 2310 may be pressed into the bushing 2340, which conforms to the bezel 2350 structure. The conformity of the bushing 2340 acts to limit the lateral deflection of the valve stem 330 and the control knob 2310. For example, the tapered contact surfaces of the bezel 2350, bushing 2340 and the control knob 2310 interact with and restrain one another from lateral movement for limiting the wobble of the control knob while allowing for rotation and axial movement of the control knob. It is noted that while the contact surfaces of the control knob assembly 2300 are described as being tapered, in alternate embodiments the contact surfaces may have any suitable shapes and contours for restricting lateral movement of the control knob for limiting wobble.

Referring to FIGS. 26-33 another exemplary control knob assembly 2600 (FIG. 33) will be described in accordance with an exemplary embodiment. In this example, the control knob assembly 2600 includes a gas valve 320 with a valve stem 330, a valve stem cap 2630, cap interface 2620, a cap interface housing 2640 and control knob 2610. It is noted that the control knob assembly 2600 may be substantially similar to control knob assembly 300 (e.g. FIG. 3) described above unless otherwise noted.

The valve stem cap 2630 includes an aperture 2631 configured to non-rotatably engage the valve stem 330. The aperture 2631 is suitably shaped and sized so that the valve stem cap 2630 can be slipped over an end of the valve stem 330. The valve stem cap 2630 also includes an outer surface 2630S having one or more substantially flat areas.

The cap interface 2620 includes an elongated aperture 2621 configured to non-rotatably engage the one or more substantially flat areas of the outer surface 2630S. The elongated aperture 2621 is configured such that the valve stem cap 2630 is allowed to move longitudinally within the elongated aperture 2621 while being substantially fixed laterally within the elongated aperture 2621 through the interaction between the one or more substantially flat areas of the outer surface 2630S and the cap interface 2620. The cap interface 2620 may also include protrusions 2622 for non-rotatably engaging the bushing 2640.

The cap interface housing 2640 includes an aperture 2641 configured such that the cap interface housing 2640 may be placed over the cap interface 2620 such that the cap interface 2620 is disposed substantially within the aperture 2641. The cap interface housing 2640 includes recesses 2642 for receiving the protrusions 2622 of the cap interface 2620 for non-rotatably securing the cap interface 2620 within the cap interface housing 2640. A first end 2646 of the cap interface housing 2640 may include a flange 2643 configured to prevent the cap interface housing from passing through an opening in the bezel 2650 when the control knob assembly 2600 is assembled. A second end 2645 of the cap interface housing 2640 may include lands and grooves 2644 for non-rotatably engaging the control knob 2610 as will be described below. The gas valve 320 with the valve stem cap 2630, cap interface 2620 and cap interface housing 2640 located thereon may be affixed to the control panel 370 in a manner substantially similar to that described above such that the second end 2645 of the cap interface housing 2640 protrudes through a hole 2690 in the control panel 370.

The bezel 2650 may be substantially similar to bezel 350 described above, however in this exemplary embodiment the bezel includes an aperture 2651 having a flared edge 2652 substantially similar to edge 481 (e.g. FIG. 13) that forms the valve restraint. The flared edge 2652 includes a bushing contact surface configured to interact with the cap interface housing 2640 to prevent lateral deflection of the valve stem 330 and control knob 2610 in a manner substantially similar to that described above. It is noted that one or more of the valve stem cap 2630, cap interface 2620, cap interface housing 2640 and bezel 2650 may be constructed of a self-lubricating material for providing, as an example, smooth operation of the control knob assembly 2600. In alternate embodiments the components of the control knob assembly 2600 may be constructed of any suitable material(s). The bezel 2650 may be secured to the control panel 370 in a manner substantially similar to that described above with respect to bezel 350 (e.g. FIGS. 11A, 11B).

The control knob 2610 may be substantially similar to control knob 310 (e.g. FIG. 3) described above, however the control knob 2610 in this exemplary embodiment may include a housing interface 2611. In one example, the housing interface 2611 may be secured to the control knob 2610 in any suitable manner. In alternate embodiments, the housing interface 2611 may be formed of unitary or one-piece construction with the control knob 2610. The housing interface 2611 may include lands and grooves 2612 that are complimentary to the lands and grooves 2644 of cap interface housing 2640 so that the control knob 2610 may be fit over and secured to the cap interface housing 2640 in a non-rotatable manner such that as the control knob 2610 is rotated the valve 320 is operated.

Referring to FIGS. 35A-40 another control knob assembly 3500 will be described in accordance with an exemplary embodiment. The control knob assembly 3500 may be substantially similar to control knob assembly 300 (e.g. FIG. 3) described above unless otherwise noted. In this exemplary embodiment, the control knob assembly 3500 includes a control knob 3510 and a valve restraint such as collar 3540. The collar 3540 may be configured to fit within and be secured in an aperture 3590 of the control panel 370 in any suitable manner. For example, the collar may include a flange 3544 configured to contact a surface of the second wall 370A of the control panel 370. Snaps 3543 may extend from the flange 3544 through the aperture 3590 for engaging a second opposite surface of the control panel for securely holding the collar 3540 within the aperture 3590. The collar may also include a bushing member 3541 suspended by webs 3545 within the flange 3544 such that one or more apertures 3547 are formed between the flange 3544 and the bushing member 3541. The apertures 3547 may allow for the passage of air around the knob into the appliance so that a suitable supply of air is supplied to one or more gas burners of the appliance. The bushing member 3541 may have a contact surface 3542 suitable sized and configured for engaging the control knob 3510 (e.g. FIGS. 36-39) and/or valve stem 330 (e.g. FIGS. 35A-35B) as will be described below for preventing lateral deflection of the valve stem 330 and control knob 3510. It is noted that the collar 3540 may be of unitary one-piece construction or comprise more than one component joined together. For example, the bushing member 3541 may be a separate member that is joined to the flange 3544 by webs 3545. It is further noted that the bushing member 3541 and flange 3544 may be constructed of the same or different materials such as, for example, a self-lubricating material and/or metallic material.

Figure 35B:
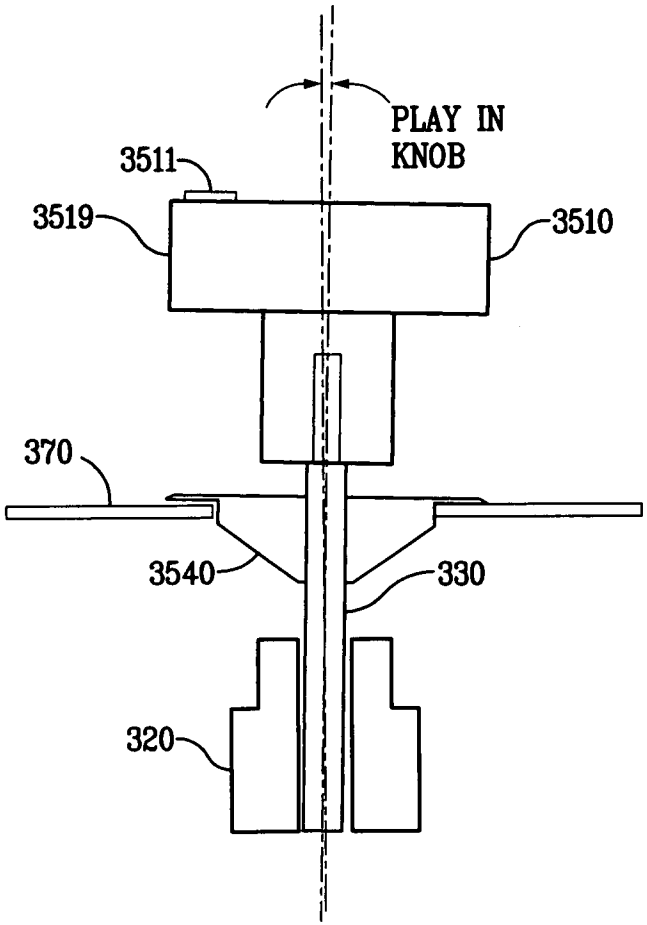
FIGS. 35A and 35B are schematic cross-sectional illustrations of a control knob assembly in accordance with an exemplary embodiment.
Figure 35A:
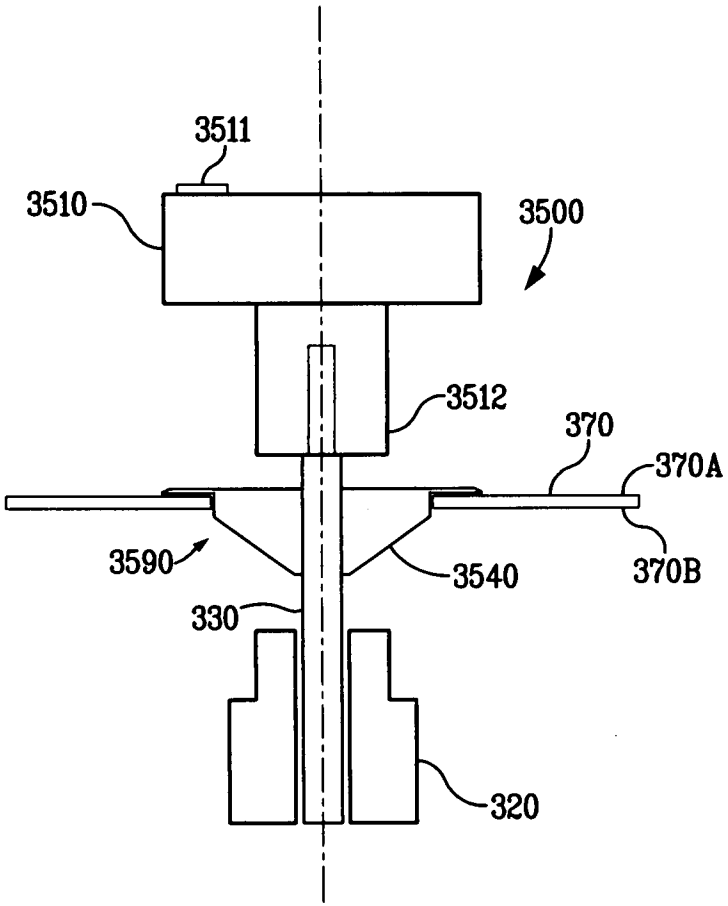
Figure 37:
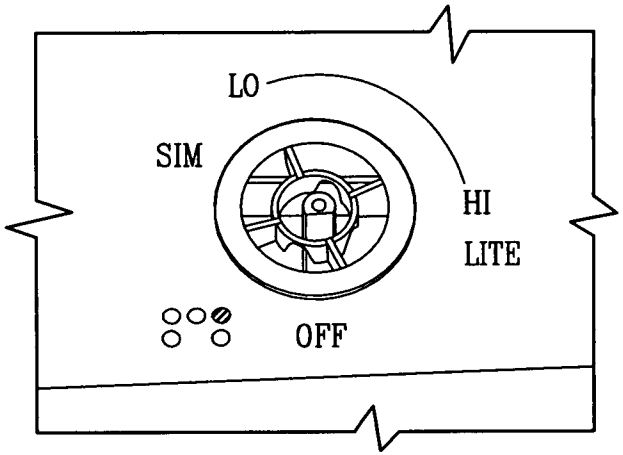
FIGS. 36-38 are schematic illustrations of a portion of a control knob assembly in accordance with an exemplary embodiment.
Figure 39:
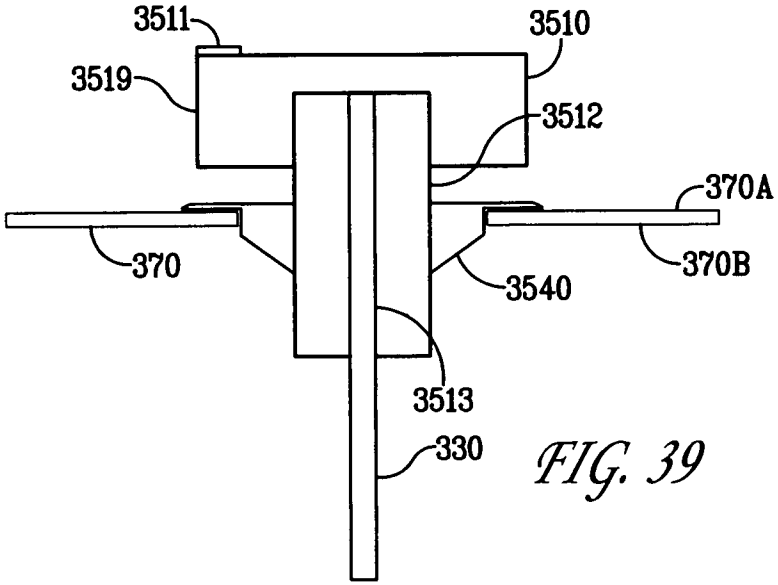
FIG. 39 is a schematic cross-sectional illustration of the control knob of FIGS. 36-38.
Figure 36:
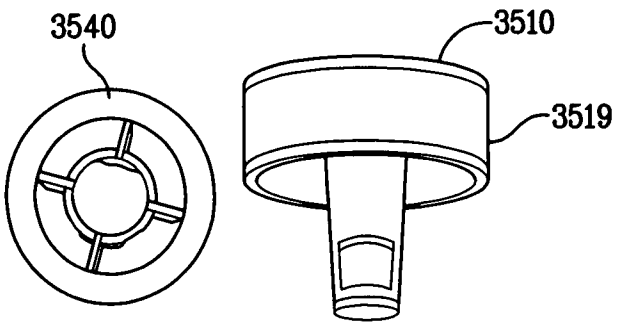
Figure 38:
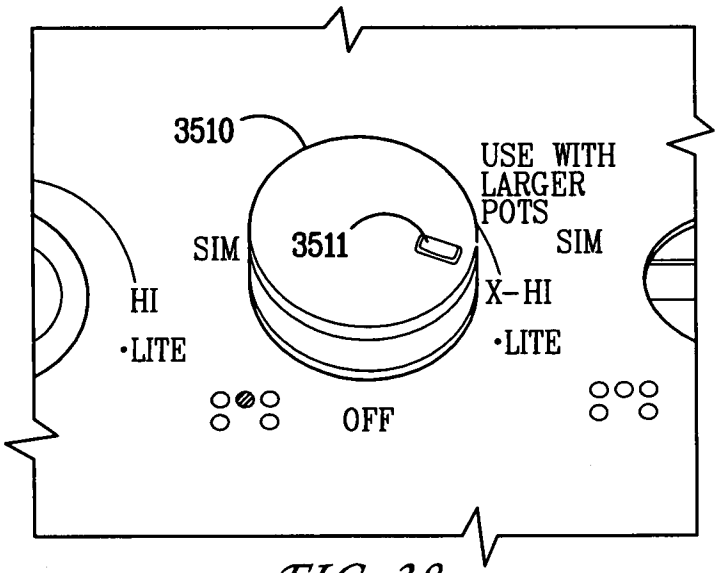
Figure 40B:
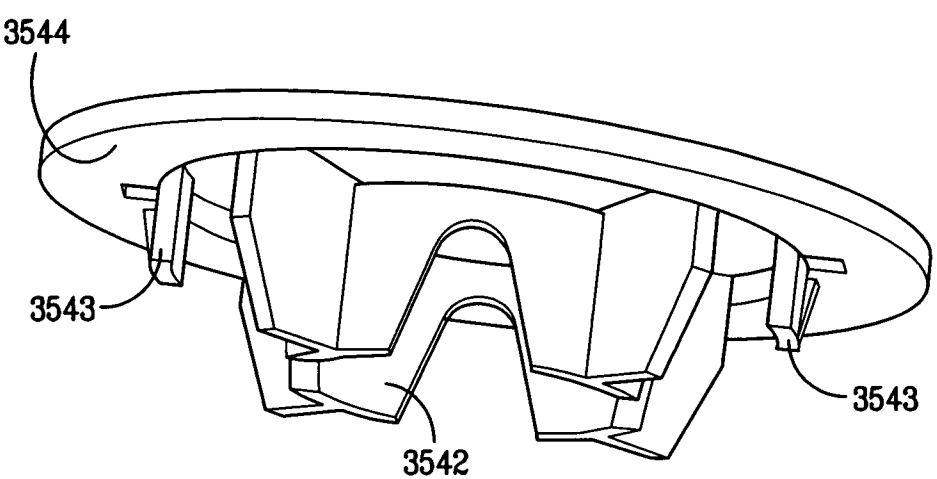
FIGS. 40A and 40B are schematic perspective illustrations of a portion of the control knobs of FIGS. 35A-39.
Figure 40A:
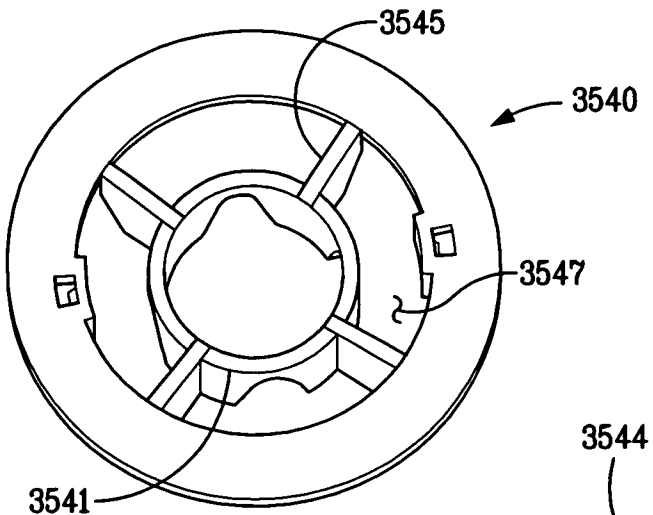

The control knob 3510 may include a grasping portion 3519, an indicator 3511 and a light guide portion 3512. The grasping portion 3519 may be suitable sized and configured to allow a user to grasp and rotate the control knob 3510. The indicator may be located on any suitable surface of the control knob 3510 such as, for example, the grasping portion 3519. The light guide portion 3512 may be fixedly attached to the grasping portion 3519 for transmitting light from any suitable light source to the indicator 3511. The light guide portion 3519 may also be configured so that it is non-rotatably fit over the valve stem 330 so that as the control knob is rotated the gas valve 320 is operated. In one exemplary embodiment the light guide portion 3512 may be in the form of a light pipe having a suitable diameter for engaging the contact surface 3542 of the bushing member 3541 such that lateral movement of the control knob 3510 and valve stem 330 is restrained to reduce wobble as described herein. In other exemplary embodiments, the light guide portion 3512 may not extend through the bushing member 3541 as shown in FIGS. 35A-35B. Here the contact surface 3542 of the bushing member 3541 may be suitably sized to engage the valve stem 330 for restraining the valve stem 330 and control knob 3510 for reducing wobble.

In alternate embodiments, the bushings and collars described herein may be fixed to or integrated into the control knobs rather than be mounted to or formed in the control panel or frame of the appliance so as to not interfere with the an up and down operation of the gas valve.

In accordance with the exemplary embodiments, the control knob assemblies described herein may be mounted in any suitable orientation such as for example, in a horizontal orientation (e.g. the axis of rotation of the knob assembly is horizontal), a vertical orientation (e.g. the axis of rotation of the knob assembly is vertical) or at any angle in between horizontal and vertical. Where the control knob assemblies are mounted vertically the bezels and collars described herein may be raised above the surface of the control panel 370 and provide seal around the control knob to substantially prevent any spilled liquids from entering the control panel.

The control knob assemblies described herein reduce wobble of a control knob assembly and provide a smooth operation of the knob. The exemplary embodiments provide a lateral restraint, such as the bushings described above, substantially rigidly connected to a frame of the appliance, such as a surface of the control panel such that the lateral restraint remains substantially fixed with respect to the gas valve system. The bushings may be configured to avoid interference in the axial travel of the gas valve or valve stem and any interference of the control knob and/or valve stem rotation. The exemplary embodiments may also provide a light path for illuminating at least a portion of the control knob to indicate to a user a setting of the appliance. An air passage may also be provided in the control knob assemblies described herein for allowing a sufficient amount of air into a combustion area of the appliance, such as at a cooktop gas burner.

Thus, while there have been shown and described and pointed out fundamental novel features of the invention as applied to the exemplary embodiments thereof, it will be understood that various omissions and substitutions and changes in the form and details of devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A gas appliance comprising:

a frame including an aperture; and a control knob assembly comprising a gas valve with a valve stem, a control knob attached to the valve stem, and a valve restraint substantially fixed relative to the frame and longitudinally disposed in the aperture of the frame substantially between the gas valve and the control knob, wherein the valve restraint comprises:

a flange engaging the frame around the aperture; and a fastening device engaging the frame around the aperture opposite the flange and cooperating with the flange to form a channel, an edge of the aperture engaging the channel to secure the valve restraint within the aperture of the frame;

the valve restraint including an aperture through which the valve stem passes, the valve restraint aperture being tapered from a first diameter at each end of the valve restraint to a smaller second diameter between the ends of the valve restraint, the valve restraint being configured to limit lateral movement of the valve stem.

2. The gas appliance of claim 1, wherein at least a portion of the control knob extends through the valve restraint for limiting the lateral movement of the valve stem and the control knob.

3. The gas appliance of claim 1, further comprising a bezel mounted to the frame and disposed between the gas valve and the control knob.

4. The gas appliance of claim 3, wherein the valve restraint is formed by a flared aperture of the bezel or inserted into an aperture of the bezel.

5. The gas appliance of claim 3, wherein at least one of the bezel and the control knob includes a bushing contact surface and wherein the valve restraint conforms to a shape of the bushing contact surface of the at least one of the bezel and the control knob.

6. The gas appliance of claim 3, wherein the control knob assembly further comprises a valve stem cap, a cap interface and a cap interface housing, wherein the valve stem cap is disposed on an end of the valve stem, the cap interface is disposed over the valve stem cap and the cap interface housing is disposed over the cap interface, the cap interface housing being configured to interface with the valve restraint for limiting the lateral movement of the valve stem and the control knob.

7. The gas appliance of claim 3, wherein the bezel includes a light guide configured to illuminate at least a portion of the control knob for indicating a setting of the gas appliance.

8. The gas appliance of claim 1, wherein the control knob assembly is mounted to a control panel of the frame such that the control knob and the valve restraint are disposed on opposing surfaces of a wall of the control panel.

9. The gas appliance of claim 1, wherein the control knob includes a light guide for indicating a setting of the gas appliance.

10. The gas appliance of claim 1, wherein the control knob assembly is mounted to a control panel of the frame, at least a portion of the control knob assembly is adjustably connected to the frame to allow for misalignment between the gas valve and a corresponding aperture of the control panel of the frame.

11. The gas appliance of claim 1, wherein at least the valve restraint comprises a self lubricating material.

12. A control knob assembly for a gas cooking appliance, the gas cooking appliance having a control panel with at least one wall, the control knob assembly comprising:

a gas valve including a valve stem having a longitudinal axis, the gas valve being disposed on a first side of the wall;

a control knob non-rotatably connected to the valve stem, the control knob being disposed at least partly on a second side of the wall; and a bushing disposed along the longitudinal axis and in an aperture of the wall between the gas valve and the control knob, the bushing including an aperture through which the valve stem passes, the aperture of the bushing being tapered from a first diameter at each end of the bushing to a smaller second diameter between the ends of the bushing, the bushing being configured to limit lateral movement of the valve stem and the control knob;

the bushing being substantially fixed relative to the wall and longitudinally disposed in the aperture of the wall, wherein the bushing comprises:

a flange on a first side of the bushing and disposed on the second side of the wall; and a fastening device on a second side of the bushing opposite the flange, the fastening device cooperating with the flange to form a channel configured to receive a frame around the aperture and secure the bushing within the frame.

13. The control knob assembly of claim 12, wherein the-control knob assembly further comprises a bezel adjacent the control knob, the bushing being inserted into an aperture in the bezel.

14. A gas cooking appliance comprising:

a control panel having at least one wall; and a control knob assembly mounted directly to the at least one wall, the control knob assembly including a gas valve with a valve stem, a bushing and a control knob, the valve stem and the control knob being connected to each other for simultaneous rotation about a longitudinal axis, the bushing including an aperture through which the valve stem passes, the aperture of the bushing being tapered from a first diameter at each end of the bushing to a smaller second diameter between the ends of the bushing, the bushing being configured to interface with one or more of the valve stem and the control knob for limiting lateral movement of the valve stem and the control knob, wherein the bushing comprises:

a flange on a first side of the bushing and disposed on one side of the at least one wall; and a fastening device on a second side of the bushing opposite the flange, the fastening device cooperating with the flange to form a channel, the bushing being secured within an aperture of the at least one wall between the control knob and the gas valve by engagement of a wall portion surrounding the aperture of the at least one wall within the channel.

15. The gas cooking appliance of claim 14, wherein the bushing is formed in the at least one wall or mounted to a side of the at least one wall.

16. The gas cooking appliance of claim 14, wherein the control knob assembly further comprises a bezel disposed at least partially between at least part of the control knob and the at least one wall, the bezel forming the wall portion that surrounds the aperture of the at least one wall and the bushing being formed in the bezel or inserted into the bezel.

* * * * *